United States Patent [19]

Stansfield et al.

[11] Patent Number: 5,077,576

[45] Date of Patent: Dec. 31, 1991

[54] PROGRAMMABLE IMAGE AREA LOCKOUT FOR DAMAGED IMAGING MEMBERS

[75] Inventors: John P. Stansfield, New York; James R. Burt, Rochester, both of N.Y.

[73] Assignee: Eastman Kodak Company, Rochester, N.Y.

[21] Appl. No.: 611,812

[22] Filed: Nov. 13, 1990

[51] Int. Cl.[5] ..... G03G 15/00

[52] U.S. Cl. ..... 355/212; 355/203; 355/77

[58] Field of Search ..... 355/212, 210, 203–207, 355/77

[56] References Cited

U.S. PATENT DOCUMENTS 4,821,066 4/1989 Foote et al. .

4,884,106 11/1989 Harris ..... 355/212

4,914,477 4/1990 Young et al. ..... 355/208

4,961,089 10/1990 Jamzadeh ..... 355/207

*Primary Examiner*—R. L. Moses

*Attorney, Agent, or Firm*—Milton S. Sales

[57] ABSTRACT

Document production apparatus has an imaging member with a plurality of image areas used to produce documents. Defective image areas can be locked out from being used to produce documents. When an image area is locked out, the apparatus enters a skip cycle mode wherein the apparatus continues to run without producing a document for a particular image area. The lockout is cancelled upon replacement of the imaging means such that previously locked out image areas can be used to produce documents.

13 Claims, 3 Drawing Sheets

PROGRAMMABLE IMAGE AREA LOCKOUT FOR DAMAGED IMAGING MEMBERS

BACKGROUND OF THE INVENTION

1. Technical Field

This invention relates generally to printer and copier apparatus having imaging members with a plurality of image areas, and more particularly to such apparatus wherein adjustments can be made to minimize the adverse effect of damaged image areas.

2. Background Art

Many commercially available copiers and printers (referred to herein without distinction as document production apparatus) have imaging members that can receive several images. For example, Eastman Kodak Company's Ektaprint copiers have an electrophotographic belt with up to six letter-sized image areas which can be charged, exposed and toned to create a transferable image. If one of the six image areas becomes damaged, a defect will be noticed on every sixth document of a single-color production run. In multiple-color production runs, the defect will occur more often, depending on the number of color separations per document. Operators have only the option of accepting less than optimum document, or remaking defective documents, or of replacing the imaging member.

DISCLOSURE OF INVENTION

It is an object of the present invention to provide for the elimination of defective reproductions due to damaged image areas on the imaging member without replacing the imaging member.

It is another object of the present invention to provide for locking out damaged image areas of an imaging member so that a locked out image area is skipped during production operations.

It is still another object of the present invention to provide a simple and direct procedure for an operator and/or field engineer to program document production apparatus to skip a damaged image area during production runs.

It is yet another object of the present invention to provide for automatically cancelling a lockout command upon replacement of a damaged imaging member.

In accordance with the present invention, these and other objects are accomplished by document production apparatus having an imaging member with a plurality of image areas, means for using selected image areas of the imaging member to produce documents, and means for locking out defective image areas from being used to produce documents.

In a preferred embodiment of the present invention, the lockout means are reset upon replacement of the imaging means such that previously locked out image areas can be used to produce documents. When an image area is locked out, the apparatus enters a skip cycle mode wherein the apparatus continues to run without producing a document for a particular image area.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
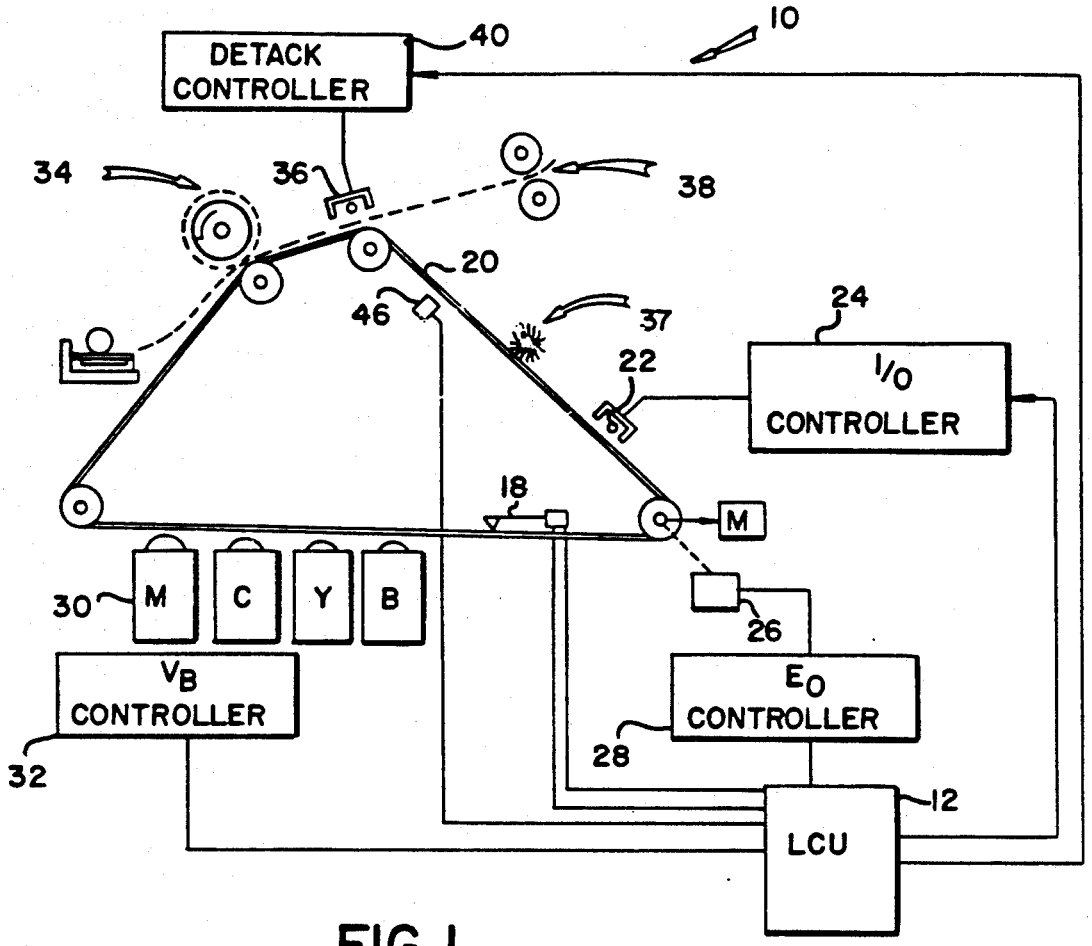
FIG. 1 is a schematic diagram showing the general arrangement of a belt-type electrophotographic copying apparatus in accordance with a preferred embodiment of the present invention.

FIG. 1 schematically illustrates various stations of a belt-type electronic exposure electrophotographic copier or printer apparatus 10. The present invention is equally suited to other types of copiers and printers such as stylus and pin recorders, migration imaging, electrofax, optical exposure, drum imaging members, and so forth.

Figure 2:
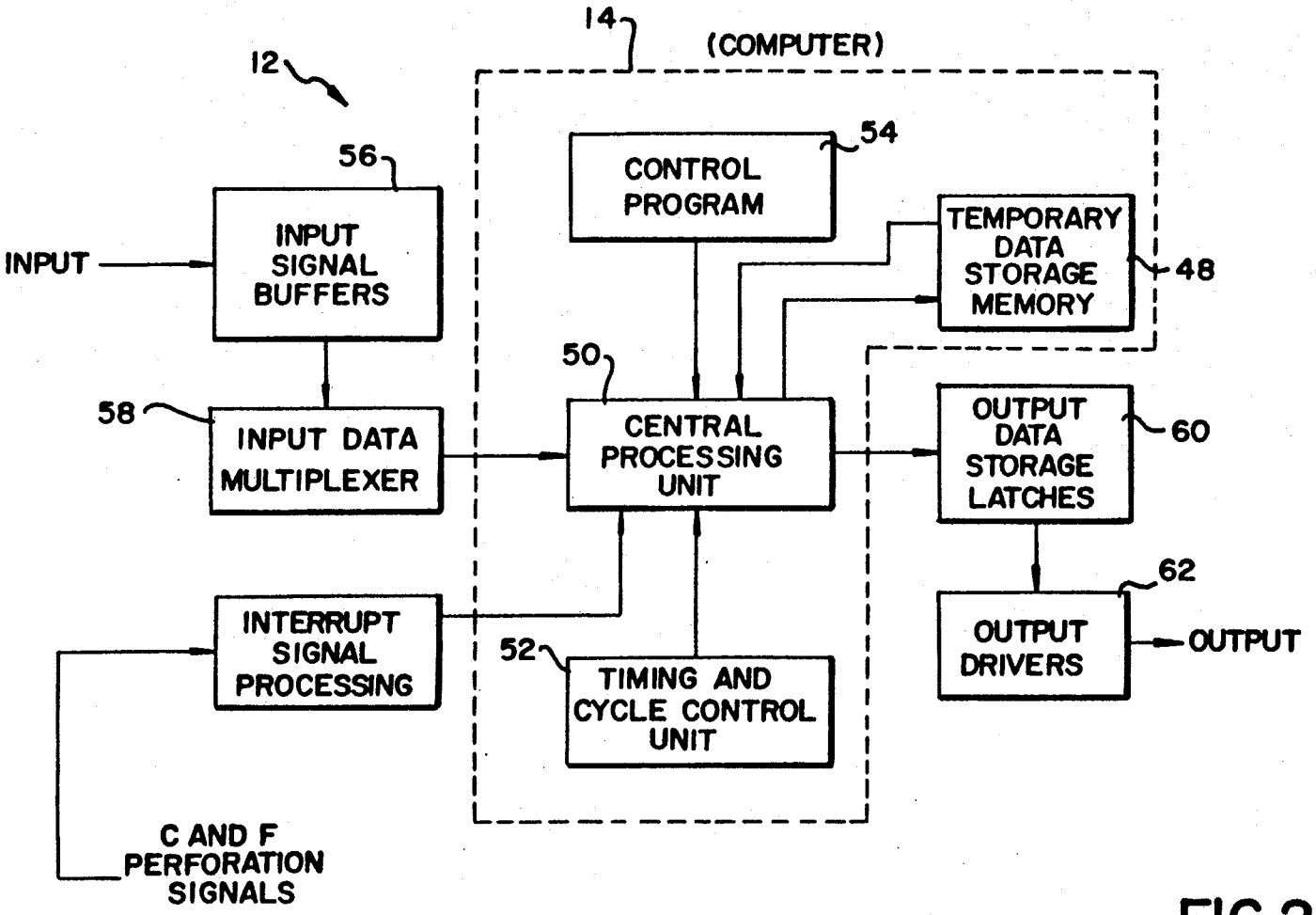
FIG. 2 is a block diagram of the logic and control unit shown in FIG. 1 for controlling the actuation of various work stations in the copying apparatus shown in FIG. 1.

Apparatus 10 includes a logic and control unit 12 having a programmable digital computer 14 (FIG. 2). Logic and control unit 12, in response to signals produced by sensors 16 and 18 (FIG. 3) which sense perforations in the edge of an imaging member photoconductive belt 20, actuates work stations in timed relation to movement of the web past the stations.

For a complete description of the work stations, see commonly assigned U.S. Pat. No. 3,914,046. Briefly, a charging station 22 sensitizes belt 20 by applying a uniform electrostatic charge of predetermined primary voltage $V_0$ to the surface of the photoconductive belt. The output of the charger is regulated by a programmable controller 24, which is in turn controlled by logic and control unit 12 to adjust primary voltage $V_0$.

At an exposure station 26, light imagewise dissipates the electrostatic charge on the image member to form a latent image of a document to be produced. Exposure station may be digital, having a light emitting diode or laser write head for exposing the image member picture-element by picture-element with an intensity and/or duration regulated by a programmable controller 28 as determined by logic and control unit 12. Alternatively, exposure may be by means of optical projection of light reflected from an original document; the light source intensity being regulated by controller 28.

Travel of belt 20 brings the areas bearing the latent charge images into a development station 30. The development station has a magnetic brush for each color toner in juxtaposition to, but spaced from, the travel path of the belt. Magnetic brush development stations are well known. For example, see U.S. Pat. Nos. 4,473,029 to Fritz et al and 4,546,060 to Miskinis et al.

Logic and control unit 12 selectively activates the development station in relation to the passage of the image areas containing latent images to selectively bring the magnetic brush into engagement with the belt. The charged toner particles of the engaged magnetic brush are attracted to the oppositely charged latent imagewise pattern to develop the pattern.

As is well understood in the art, conductive portions of the development station, such as conductive applicator cylinders, act as electrodes. The electrodes are connected to a variable supply of D.C. potential $V_B$ regulated by a programmable controller 32. A transfer station 34, a detack 36, and a cleaning station 37 complete the film loop. After transfer of the unfixed toner images to a receiver sheet at station 34, such sheet is separated from belt 20 at detack 34 and transported to a fuser station 38 where the image is fixed. Detack bias is regulated by a controller 40.

Figure 3:
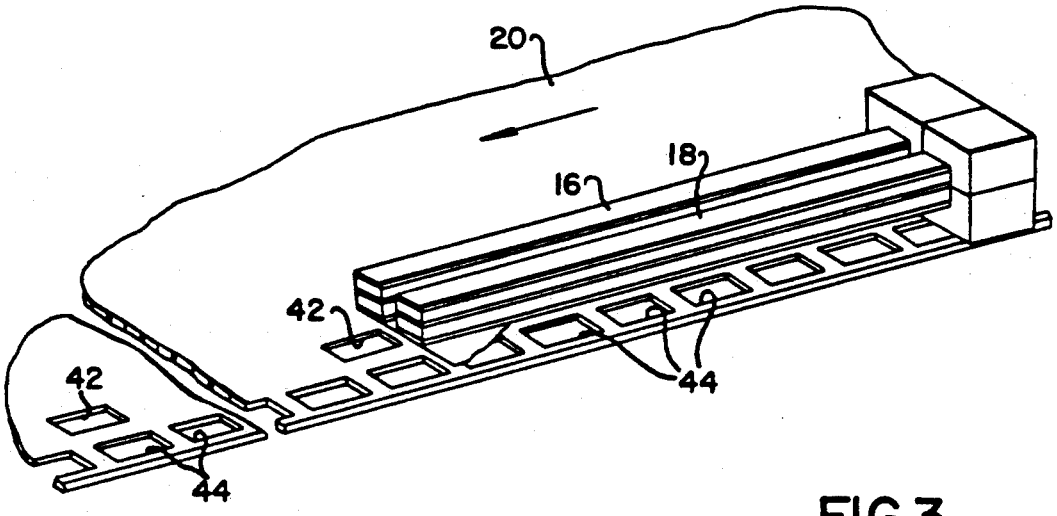
FIG. 3 is a partial perspective view showing in detail a portion of the photoconductive belt and bimorph sensors also shown in FIG. 1.

Reference should now be made to FIG. 3 which shows in detail a portion of belt 20 having along its border two rows of indicia or perforations 42 (also referred to herein as "F" perforations) and 44 (also referred to herein as "C" perforations). Between adjacent "F" perforations 42 is defined an image area. By that, it is meant an image area is a place across the entire width of belt 20 wherein a charge pattern corresponding to an image may be placed.

There is a predetermined number of equally spaced "C" perforations disposed between adjacent "F" perforations 42 which too are equally spaced along belt 20, the distance between adjacent "F" perforations 42 being much greater than that between adjacent "C" perforations 44.

As shown, sensor 16 is adapted to sense "F" perforations 42 and to provide a signal which is inputted to logic and control unit 12 each time an "F" perforation 42 is sensed. Sensor 18 is adapted to provide a clock pulse to the logic and control unit, each time a "C" perforation 44 is sensed. The logic and control unit uses the pulses from both sensors 16 and 18 to control and synchronize the various work stations of the electrophotographic operation with respect to the moving image areas; such as set forth in commonly assigned U.S. Pat. No. 3,914,047.

A third detector 46 is provided to sense the passage of the splice in belt 20. Splice detector 46 may, for example be actuated by a dedicated perforation in the belt or by the slight difference in belt thickness at the splice, or by any other suitable means for designating the presence of the splice.

Conventionally, splice detectors are provided so that the machine logic does not locate an image area in alignment with the splice, as this would result in an image artifact. In accordance with the preferred embodiment of the present invention, however, the splice detector is provided also to locate a "home" position to which image areas can be related.

Returning now to FIG. 2, a block diagram of logic and control unit 12, which interfaces with the various electromechanical subsystems, is shown. The logic and control unit consists of temporary data storage memory 48, central processing unit 50, timing and cycle control unit 52 and a stored program control 54. Data input and output is performed sequentially under program control. Input data is either applied through input signal buffer 56 to a multiplexer 58 or from sensors 16, 18, and 46 which indicate "F" perforations, "C" perforations, and the belt splice, respectively. The input signals to signal buffer 56 consist of logic level digital signals which are derived from various switches, sensors and analog-to-digital converters.

The output data and control signals from computer 14 are applied to storage latches 60 which provide inputs to suitable output drivers 62 directly coupled to the leads for the work stations. More specifically, the output signals from the LCU are logic level, digital signals which are buffered and amplified to provide drive signals to various clutches, brakes, solenoids, power switches and numeric displays in the various work stations. The LCU processing functions can be programmed by changing the instructions stored in the computer memory.

The time sequence of machine control signals is critical to the copy because machine stations and associated mechanisms (often referred to as events) must be powered ON and OFF in the correct sequence to assure high quality copy and to prevent paper misfeeds, misregistration and erratic operation. The primary mechanism for controlling the time sequence of events and their relationship to each other is, as noted above, to sense the location of the image elements as they continuously cycle, and to thereby synchronize the various control mechanisms to the location of the image elements. The mechanisms for accomplishing this, as previously noted, is to sense perforations which are spaced equidistant along the edge of the belt 20. The belt, as noted above, is divided into six image areas by "F" perforations and each image area is subdivided into 51 sections by "C" perforations.

Machine sequencing control is implemented in the logic and control unit by converting signal timing and combinational logic requirements to programs that control the logic and control computer. These control programs establish the basic operating mode and sequence of events for the machine subsystems. Details of copy cycle controls suitable for use in apparatus 10 can be found in commonly assigned U.S. Pat. No. 3,914,047, which issued to W. E. Hunt et al. on Oct. 21, 1975, the disclosure of which is hereby incorporated herein.

One function of the machine sequencing control is to place the apparatus into a "skip cycle" mode as required. In the skip cycle mode, the document production apparatus continues to run, but without paper feed, and with appropriate adjustment to charging, toning, erasing, and cleaning processes.

Imaging members like photoconductive belts and drums are subject to wear and damage. As such, they are made to be replaceable, either by a skilled operator or by a technical service representative. However, replacement of an imaging member when only one (or a very few) image areas is damaged is expensive and wasteful, especially in situations where throughput rate is not critical.

Accordingly, the present invention provides the ability for an operator or technical service representative to adjust the machine sequencing control so that the apparatus automatically goes into a skip cycle mode when the damaged image area is to be used. This, in effect, locks out the damaged image area from further use.

Figure 4:
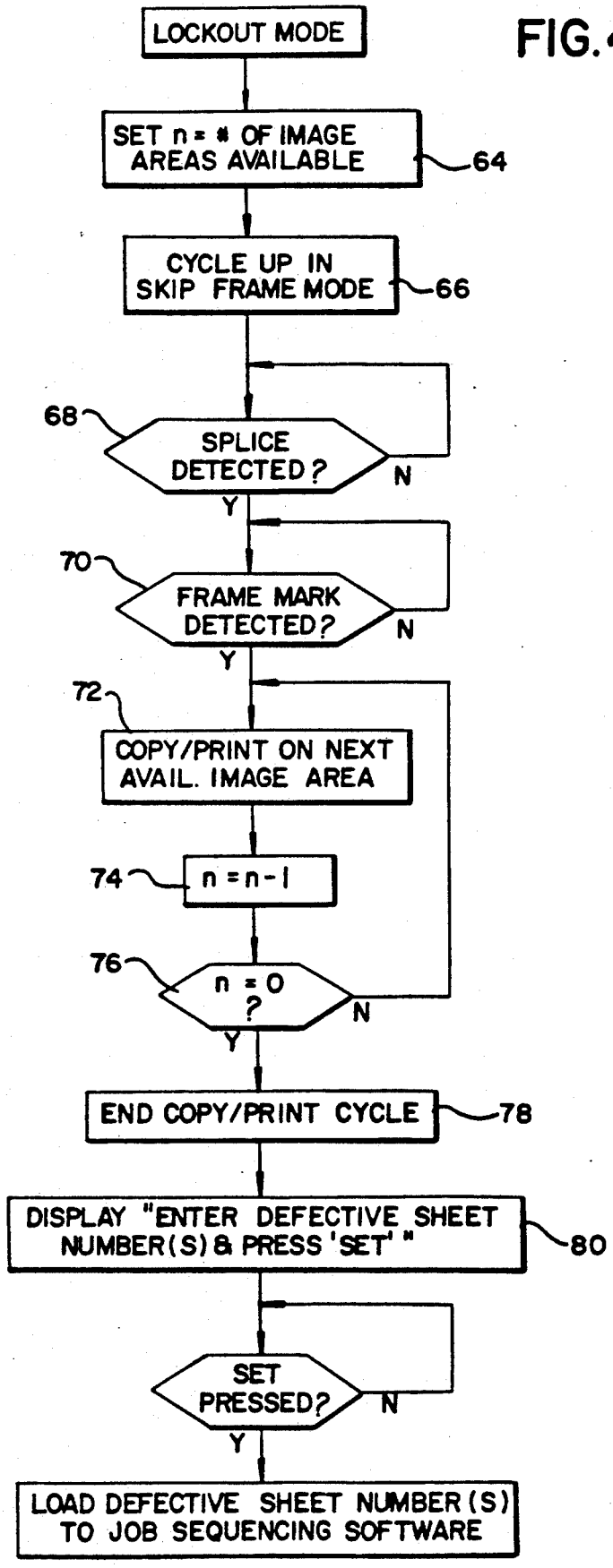
FIG. 4 is a logic flow chart according to the preferred embodiment of the present invention.

When an user of the apparatus notes the existence of artifacts which repeat regularly from page-to-page, it is highly likely that one or more image areas on the imaging members is damaged. The user initiates an image area lockout program by depressing a button or buttons on the operator control panel, not shown. Lockout mode software, stored in control program 54 of computer 14 begins operation, and FIG. 4 is a logic flow chart of the preferred embodiment of the program.

When the Lockout Mode program is started, a value "n" is set to the number of image areas available on the imaging member (logic step 64). In the above example, "n" would be set to the value of six if none of the image areas had previously been locked out. Otherwise, "n"

would be set to the number of image areas not previously locked out.

The apparatus cycles up (logic step 66) and goes into its skip frame mode until a splice is detected (decision step 68). Thereupon, skip cycles continue until the first available image area beyond the splice is positioned to receive an exposure (decision step 70 and logic step 72).

The value "n" is decremented and the process is repeated until all available image areas have been exposed and used to produce a document. Any unavailable image areas will be skipped in the process (logic steps 74, 76, and 78). An operator interface will display the message "ENTER DEFECTIVE SHEET NUMBER(S) AND PRESS 'SET'" (logic step 80). The operator will inspect the printed documents, entering on a keypad the number of any sheet or sheets which are defective.

Once the image areas which produce bad images have been designated to the job sequencing software, production runs can be made without the poor quality images which would result from using those image areas. Whenever the designated image area is to be used during the production run, it is considered to be "unavailable" by the job sequencing software, and the apparatus automatically goes into a skip frame mode for that image area.

When the image receiver is replaced, the job sequencing software is reset to cancel the lockout commands. All image areas of the new image receiver are thereupon considered to be available.

The invention has been described in detail with particular reference to preferred embodiments thereof, but it will be understood that variations and modifications can be effected within the spirit and scope of the invention. For example, image areas can be identified by any suitable means, including encoders, marks on pulleys or drums about which the belt is trained, etc. Further, the image area count need not start from a splice, but may begin at any repeatable position on the image receiver, however identified.

What is claimed is:

1. Document production apparatus having an imaging member with a plurality of image areas; said apparatus having:

means for using selected image areas of the imaging member to produce documents; and means for locking out defective image areas from being used to produce documents.

2. Document production apparatus having an imaging member with a plurality of image areas; said apparatus having:

means for using selected image areas of the imaging member to produce documents;

means for designating image areas of the imaging member as being defective; and means for locking out designated image areas from being used to produce documents.

3. Document production apparatus as defined in claim 2 wherein:

said imaging member is replaceable; and said apparatus further comprises means for resetting the locking out means upon replacement of said imaging means such that previously locked out image areas can be used to produce documents.

4. Document production apparatus having an imaging member with a plurality of image areas; said apparatus having:

means for repeatedly producing transferable images on selected image areas of the imaging member;

means for designating image areas of the imaging member as being defective; and means for locking out designated image areas from being used to produce documents.

5. Document production apparatus having an imaging member with a plurality of image areas, a production mode for producing documents, and a skip cycle mode wherein the apparatus continues to run without producing a document for a particular image area; said apparatus having:

means for using selected image areas of the imaging member to produce documents in the production mode; and means for placing the apparatus in the skip cycle mode for defective image areas.

6. Document production apparatus having an imaging member with a plurality of image areas; said apparatus having:

a production mode wherein selected image areas of the imaging member are used to produce documents;

means for identifying and designating defective image areas of the imaging member;

a skip cycle mode wherein the apparatus continues to run, but without producing a document for one or more image areas; and sequencing control means for placing the apparatus in the skip cycle mode for designated defective image areas.

7. Document production apparatus having an imaging member with a plurality of image areas and machine sequencing control means for controlling operation of the apparatus; said document production apparatus further comprising:

means for detecting a predetermined position along the imaging member;

means operable by the machine sequencing control means for producing documents on selected image areas of the imaging member;

means for designating defective image areas by their spacial relationship relative to said predetermined position; and means operable by the machine sequencing control means for looking out designated image areas from being used to produce documents.

8. Document production apparatus as defined in claim 7 wherein:

said imaging member is a flexible belt; and said detecting means is a splice detector.

9. Document production apparatus as defined in claim 7 wherein said imaging member is replaceable and said apparatus further comprises means for resetting the locking out means upon replacement of said imaging means.

10. A process for producing a document using an imaging member with a plurality of image areas; said process comprising the steps of:

using selected image areas of the imaging member to produce documents; and locking out defective image areas from being used to produce documents.

11. A process as defined in claim 10 further comprising the steps of:

selectively replacing imaging members which have defective image areas; and resetting the locking out means upon replacement of said imaging member.

12. A process for producing a document using an imaging member with a plurality of image areas; said process comprising the steps of:

identifying and designating defective image areas of the imaging member; and placing the apparatus in the skip cycle mode for designated defective image areas.

13. A process for producing a document using an imaging member with a plurality of image areas; said process comprising the steps of:

detecting a predetermined position along the imaging member;

producing documents on selected image areas of the imaging member;

designating defective image areas by their spacial relationship relative to said predetermined position; and locking out designated image areas from being used to produce documents.

* * * * *

UNITED STATES PATENT OFFICE

CERTIFICATE OF CORRECTION

Patent No. 5,077,576 Dated December 31, 1991

Inventor(s) John P. Stansfield and James R. Burt

It is certified that error appears in the above-identified patent and that said Letters Patent is hereby corrected as shown below:

Col. 6, Claim 7, line 47 after "for" change "looking" to --locking--.

Signed and Sealed this

Twentieth Day of April, 1993

*Attest:*

MICHAEL K. KIRK

*Attesting Officer*

*Acting Commissioner of Patents and Trademarks*